US005498930A

United States Patent [19]

Loy et al.

[11] Patent Number: 5,498,930

[45] Date of Patent: Mar. 12, 1996

[54] METHOD OF DIMENSIONING AND OPERATING A LOW PRESSURE DISCHARGE LAMP

[75] Inventors: Helmut M. Loy, Torreglia, Italy; Sigurd Kohler, Höchstadt; Armin Eich, Erlangen, both of Germany

[73] Assignee: GTE Products Corporation, Danvers, Mass.

[21] Appl. No.: 730,951

[22] PCT Filed: Jan. 20, 1989

[86] PCT No.: PCT/EP89/00063

§ 371 Date: Jun. 10, 1993

§ 102(e) Date: Jun. 10, 1993

[87] PCT Pub. No.: WO90/08399

PCT Pub. Date: Jul. 26, 1990

[51] Int. Cl.[6] ..... H05B 39/00

[52] U.S. Cl. ..... 315/97; 315/99; 313/574; 313/491

[58] Field of Search ..... 315/98, 99, 97; 313/492, 574, 491

[56] References Cited

U.S. PATENT DOCUMENTS 4,734,616 3/1988 Northrop ..... 313/492

*Primary Examiner*—Robert J. Pascal
*Assistant Examiner*—Reginald A. Ratliff
*Attorney, Agent, or Firm*—Carlo S. Bessone

[57] ABSTRACT

In a method of dimensioning and operating by A.C. or D.C. at a predetermined external heater power a low pressure discharge lamp, particularly a fluorescent lamp having two electrodes between which the discharge is formed, at least one of the electrodes being alkaline earth oxide coated and adapted to form a permanently heated cathode, particularly for use in video matrix board, and external heater current is used which is approximately 1.5 to 5 times higher than the discharge current, the heater volt is approximately 33.33% to 80% lower than that of a conventionally operated cathode or electrode, respectively, and the wattage of the heater circuit is maintained. By this accuracy of optimum cathode temperature control is improved, enhanced lamp life and reduced discoloration are obtained and the formation of hot spots avoided.

3 Claims, 2 Drawing Sheets

METHOD OF DIMENSIONING AND OPERATING A LOW PRESSURE DISCHARGE LAMP

FIELD OF THE INVENTION

The invention relates to a method of dimensioning and operating by A.C. or D.C. at a predetermined external heater power a low pressure discharge lamp having two electrodes between which the discharge is formed, at least one of the electrodes being alkaline earth oxide coated and adapted to form a permanently heated cathode, particularly for use in video matrix displays.

BACKGROUND OF THE INVENTION

In low pressure discharge lamps the discharge is formed between electrodes. These operate alternatively as anode or cathode, respectively, if the lamp is supplied with A.C., or permanently as anode or cathode in case of D.C. operation. Cathodes consist usually of a coiled tungsten wire which is coated with a mixture of alkaline earth oxides to enhance thermionic electron emission.

The life of a fluorescent lamp is mainly determined by the life of the cathode.

The physical behaviour of an oxide coated cathode is complex. Roughly the cathode exists in a sensitive equilibrium of thermionic emission and evaporation of emissive material.

SUMMARY OF THE INVENTION

There is an optimum temperature of the emissive coating at which electron emission is high enough to maintain the discharge and evaporation is low enough to grant sufficient life.

Rapid starting of a low pressure discharge lamp is accomplished by current heating of the cathode—or, in case of A.C. operation, both electrodes—to a temperature which provides for sufficient thermionic emission. The heating mode is permanent, i.e. the heater is externally and permanently heated. The external heater current is normally chosen equal to the discharge current.

In operating low pressure discharge lamps, particularly fluorescent lamps with externally heated cathode(s) the discharge current is superposed to the heater current and therefore forms a locally overheated area (hot spot). Due to temperature difference of about 400–500 K encountered with the known lamps and their operation as described above, the evaporation rate of the emissive oxides increases by orders of magnitude. This, in turn, leads to increased blackening and, ultimately, reduced life of the lamp.

It is an object of the present invention to provide a method as mentioned above in the first paragraph of the description by which the functional life of lamps as indicated above can be increased and the end blackening or end discoloration, respectively, reduced.

This object is met in that an external heater current is used which is approx. 1.5 to 5 times higher than the discharge current and that the heater voltage is approx. 33.33% to 80% lower than that of a conventionally operated cathode or electrode, resp., and that the wattage of the heater circuit is maintained.

BEST MODE FOR CARRYING OUT THE INVENTION

Figure 1:
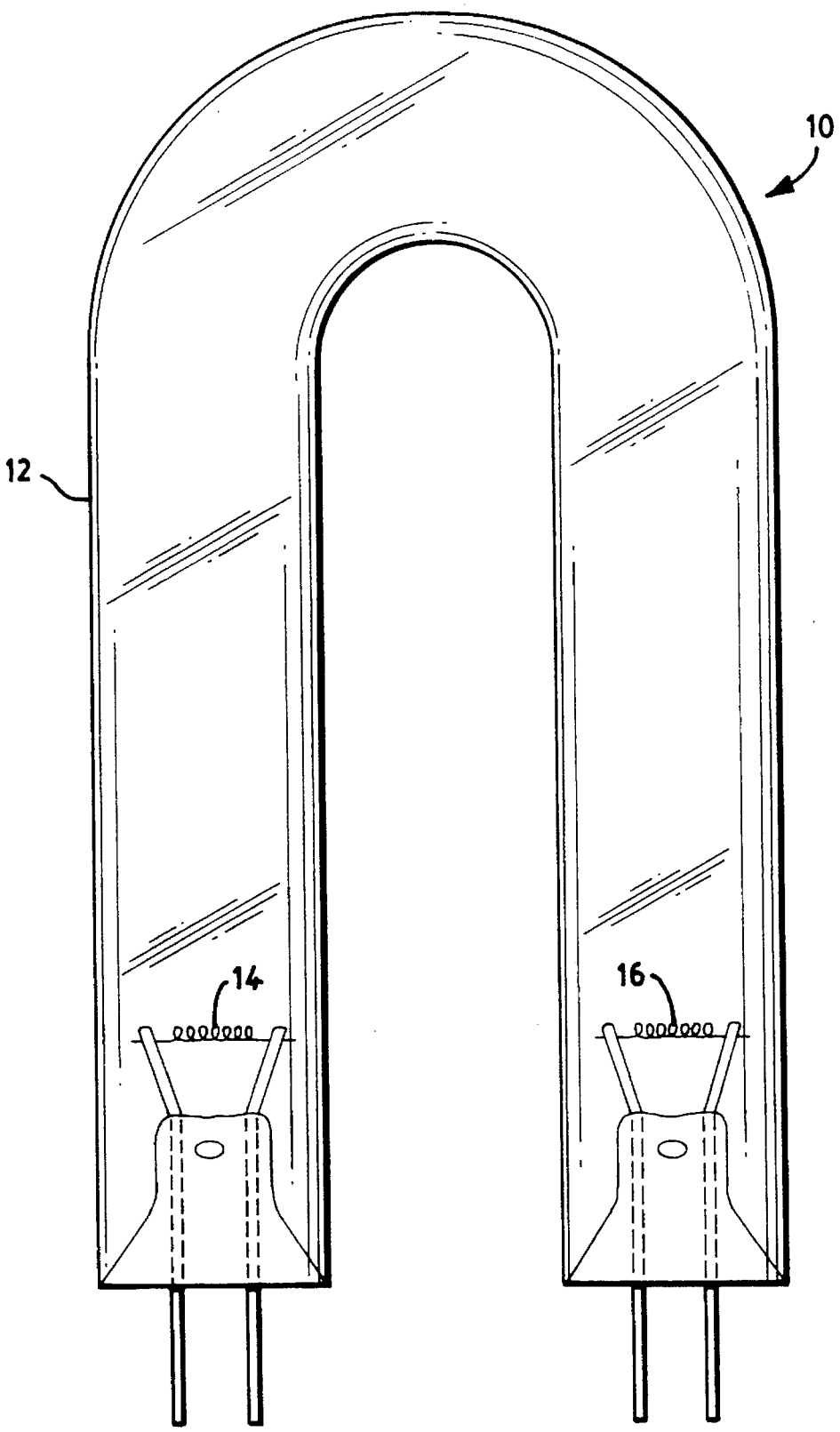
FIG. 1 is a low pressure discharge lamp having two cathodes.

With particular attention to FIG. 1, there is illustrated a low pressure discharge lamp 10 having a U-shaped tube and two electrodes 14 and 16.

The main advantage of the inventive method resides in the fact that to improve the accuracy of control of the desired optimum cathode temperature and thereby enhance lamp life and reduce discoloration the contribution of discharge current heating is minimized and the contribution of the external heater current is maximized so that cathode temperature will not constantly rise and fall to such extents that the adverse effects elucidated above including the formation of hot spots are encountered.

The inventive dimensioning of the external heater current on one side and the heater voltage on the other will normally include to increase cathode wire size and/or to decrease total filament length to permit coil heat to be supplied at higher current and lower voltage.

A preferred embodiment of the method according to the invention is characterized in that for increasing the heater current I to n·I and decreasing the heater voltage U to U/n the radius r of the wire forming the cathode or electrode, resp., is dimensioned to $\sqrt{n}\cdot r$, the cross section A of the wire is increased to n·A and the wire length L is reduced to L/n, whereby the resistance R is reduced to $$\frac{R}{n^2}.$$

Preferably, n is a number equal to approximately 1.5 to 5.

The reduced resistance of the coll reduces the $I^2\cdot R$ heating by arc current. The higher heat conductivity of the heavier wire more effectively dissipates ion bombardment heating in the cathode spot, with reduced temperature rise. Thus, the cathode spot temperature becomes much less sensitive to arc current conditions and is controlled by the coil heat power instead.

Achieving reliable uniform life of fluorescent lamps requires achieving reliable control of cathode operating temperature. This is possible for the first time by means of the instant invention. If cathodes are designed in accordance with the prior art, with a substantial portion of the cathode power input being derived from the arc current, it is apparent that satisfactory control of cathode spot temperature over different discharge current conditions will be impossible to achieve. This holds good particularly for fluorescent lamps used in video matrix boards where operation of each lamp may occur at anyone of e.g. 32 different discharge currents on duty cycles ranging from continuous burning at maximum current to being excited only for a few hundredths of a second at a low current.

The invention has been verified in practice with an embodiment in which there was used an external heater current being 3.2 times higher and a heater voltage being 3.2 times lower than that with a conventional operated cathode.

Figure 2:
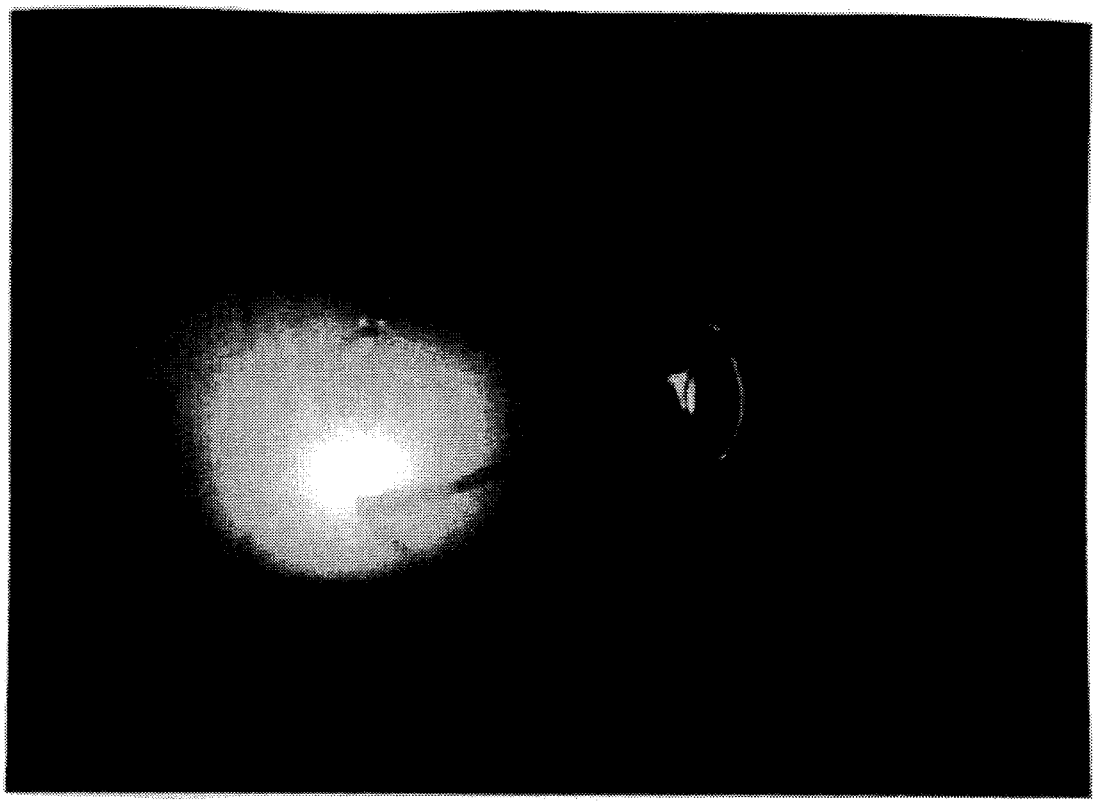
FIG. 2 is a photograph showing a cathode having a hot spot.
Figure 3:
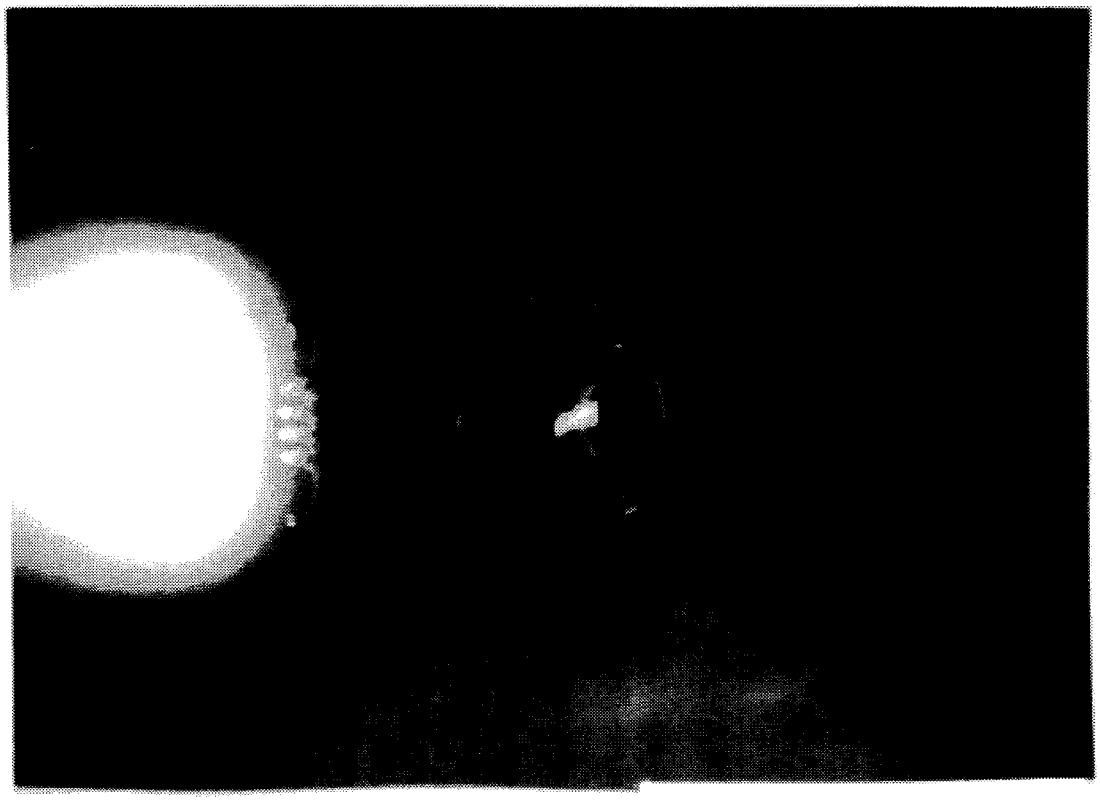
FIG. 3 is a photograph showing a cathode having no hot spot.

Reference is made to FIG. 2 and photo II as attached, FIG. 2 showing a cathode having a hot spot of 450° K. over temperature, whereas FIG. 3 is showing a cathode having no hot spot and an optimal thermionic emission temperature.

If the cathode in accordance with FIG. 2 is called a type I and the cathode in accordance with FIG. 3 is called type II, the following is an indication of the differences between both types, type II being identical to type I except for heater voltage, heater current and heater operation resistance, please see the following data:

Type I

U-shaped tube

One electrode: oxide coated tungsten coil cathode

One electrode: anode gas fill: argon, mercury fill pressure 3.5 mbar without phosphor discharge current 125 mA D.C.

arc voltage: 25 V heater voltage: 8 VD.C.

heater current: 0.125 A D.C.

heater operation resistance: 64 Ohm heater power: 1 W

Type II identically, except of:

heater voltage: 2.5 V D.C.

heater current: 0.4 A D.C.

heater operation resistance: 6.25 Ohm heater power: 1 W

Measured thermionic emission temperature:

Type I: 1350° C. (hot spot)

Type II: 900° C. (without hot spot)

As a conclusion, if the external heater current of a permanently heated fluorescent lamp is substantially higher than the discharge current, local overheating of the cathode or the formation of a hot spot, resp., is reduced or eliminated and results in increased lamp life and less blackening.

Particularly in case of intensity modulated fluorescent lamps as represented by video matrix display lamps used in the boards mentioned above it is possible to supply the cathode with A.C. instead of D.C. In addition, the vibration resistance of the lamps is improved.

We claim:

1. Method of dimensioning and operating by A.C. or D.C. at a predetermined external heater power a low pressure discharge lamp, particularly a fluorescent lamp having two electrodes between which the discharge is formed, at least one of the electrodes being alkaline earth oxide coated and adapted to form a permanently heated cathode, characterized in that an external heater current is used which is approximately 1.5 to 5 times higher than the discharge current, that the heater voltage is approximately 33.33% to 80% lower than that of a conventionally operated cathode or electrode, respectively, and that the wattage of the heater circuit is maintained.

2. Method according to claim 1, characterized in that for increasing the heater current I to n·I, wherein n is a number, and decreasing the heater voltage U to $$\frac{U}{n}$$

the radius r of the wire forming the cathode or electrode, resp., is dimensioned to $\sqrt{n}\cdot r$, the cross section A of the wire is increased to n·A and the wire length L is reduced $$\frac{L}{n},$$

whereby the resistance R is reduced to $$\frac{R}{n^2}.$$

3. Method according to claim 1 or 2, characterized in that there is used an external-heater current which is 3.2 times higher and a heater voltage which is 3.2 times lower than that with a conventionally operated cathode or electrode, respectively.

* * * * *